United States Patent [19]

Golembiski

[11] Patent Number: 4,823,843

[45] Date of Patent: Apr. 25, 1989

[54] VALVE APPARATUS

[75] Inventor: Francis H. Golembiski, Elverson, Pa.

[73] Assignee: Aptec, Inc., Honey Brook, Pa.

[21] Appl. No.: 201,081

[22] Filed: Jun. 1, 1988

[51] Int. Cl.[4] ..... F16K 23/00; F16K 11/20

[52] U.S. Cl. ..... 137/637.1; 137/605; 137/885; 137/887; 431/121

[58] Field of Search ..... 137/605, 637.1, 885, 137/887; 431/29, 121

[56] References Cited

U.S. PATENT DOCUMENTS 4,146,056 3/1979 Buchanan ..... 431/121 X

*Primary Examiner*—Gerald A. Michalsky

*Attorney, Agent, or Firm*—Howson & Howson

[57] ABSTRACT

In a valve system for controlling the flow of liquid fuel and steam to a nozzle in a large scale power plant boiler, a pair of valves are operated by rotary pneumatic actuators. Three-position operation is achieved for one of the valves by coupling the valve shafts together through a lost-motion coupling and using an actuator for the other valve which delivers more torque than the actuator which operates the three-position valve. The same actuator and coupling system can be used for straight high pressure mechanical atomization, for mechanical atomization with recirculation, and for steam atomization, with simple substitution of rotary valves.

10 Claims, 4 Drawing Sheets

VALVE APPARATUS

BRIEF SUMMARY OF THE INVENTION

This invention relates to valves, and more specifically to a valve apparatus for use in controlling the flow of two different fluids alternately to a single destination. The valve apparatus of the invention has particular utility in large scale oil-fired power plant boilers for controlling the flow of liquid fuel and scavenging gas.

Power plant boilers typically use No. 6 fuel oil, which is solid or nearly solid when at room temperatures. The oil is sprayed into the combustion chamber of the boiler through nozzles. Each nozzle has at least one feed line connected to it for carrying oil heated to approximately 190° F. so that it is fluid, and for carrying steam or air. The steam or air is used for purging oil from the nozzle and the associated feed line and, in some cases also for dispersing the fuel into small droplets as it exits from the nozzle.

There are three basic types of fuel dispersion methods in use in oil-fired power plant boilers. In the first method, known as "high pressure mechanical atomization", fuel is dispersed simply by spraying it through the nozzle. In the second method, known as "wide range mechanical atomization", fuel is recirculated through the nozzle, and the rate at which fuel is sprayed by the nozzle is controlled by adjusting the back pressure in the recirculation path. In the third method known as "steam atomization" or "air atomization", fuel is dispersed with the aid of steam or air which flows into the combustion chamber along with the fuel.

Each combustion chabmer may have a large number of nozzles, and provisions are made for retracting the nozzles so that, under conditions of maximum load, all of the nozzles can be in operation, whereas under conditions of less demand, some of the nozzles can be retracted so that the nozzle tips are shielded from the flame. When a nozzle assembly is withdrawn, the flow of fuel is cut off.

With all three atomization methods, previsions are made to purge fuel from the nozzle passages to prevent it from solidifying and clogging the passages when a nozzle is temporarily taken out of service. This is accomplished by providing for delivery of a scavenging gas, usually steam or air, to the nozzle passages in order to displace the remaining fuel in the nozzle passages before it cools and solidifies. For convenience, the scavenging gas will be referred to as "steam", as steam is the gas most commonly used.

In the past, fuel and steam were controlled by manually operated valves. Steam-atomized systems included a valve in the steam line, a valve in the fuel line, and a cross-over valve which allowed steam to flow into the fuel line.

Steam is normally supplied under a pressure higher than that of the fuel. Using the manual system, when a nozzle is withdrawn and shut down, oil is purged by steam from the portion of the oil feed line between the nozzle and the fuel shut-off valve. If the frame goes out as the nozzle is shut down, it will not automatically reignite as oil is purged. Consequently, a great deal of smoke can be produced. It is very difficult to prevent flame-out when shut-down of a nozzle is carried out using manually-operated valves.

Auxiliary, kerosene-fired burners have been provided to insure against flame-out. However, a preferred method is to use an automatic valve such as a SKOTCH valve sold by Skotch, Inc. of 278 Main Street, Portland, Ct. 06480. The SKOTCH valve is a linear-actuated valve controlling both steam and fuel flow so that steam is gradually fed into the passage between the fuel valve and the nozzle opening as fuel flow is shut off. The steam pushes the fuel out through the nozzle opening and purges the fuel line while the flame is maintained. Thus, when the nozzle assembly is later withdrawn, it is clear of fuel, and can cool down without fuel solidifying in it.

The SKOTCH valve is heavy and complex. It includes two linear actuators which act in tandem to operate a specially-designed valve steam assembly which controls both the steam valve and the fuel valve in the appropriate sequence.

The principal object of this invention is to provide a valve apparatus for controlling fluids such as liquid fuel and scavenging gas, which is more reliable and easier to use than prior manual systems, and which is also simpler and less expensive than prior automatic valve systems. It is also an object of the invention to provide a valve apparatus which is more versatile than prior systems in that it can readily be adapted to any of the three basic fuel dispersion methods by the simple substitution of readily available parts.

A still further object of the invention is to provide a valve apparatus which is more compact than prior equipment provided for the same purpose, which is easily serviced, and which is lighter in weight. It is also an object of the invention to provide for control of the speed of operation of the valves in a valve system in order to achieve smooth transitions between operations and to avoid hammering which results from excessively rapid valve operation.

Finally, it is an object of the invention to provide for visual indication of valve positions and to provide for manual operation as an alternative to automatic operation.

The valve apparatus of the invention comprises two rotary valves, one being a two-position valve, and the other being a three-position valve. Each valve is controlled by an actuator, preferably a rotary, fluid-driven, vane-type actuator operated by air delivered to it through a solenoid valve. The actuator which operates the two-position valve is designed to deliver a higher torque than the actuator which operates the three-position valve. The two actuators (and thereby, the two valves) are interconnected through a lost-motion coupling which effectively limits rotation of the second valve so that, if the actuator for the second valve is operated while the first valve is in a first position, the second valve stops at its intermediate position. The second valve is allowed to move to its ultimate position only when the first valve moves to its second position. The lost-motion coupling, therefore, provides a simple means of achieving the three stages of operation required in each of the three basic atomizing methods. In the first stage, both steam and fuel are shut off. In the second stage, steam is delivered to the nozzle tip, thereby removing condensate and warming the nozzle to its operating temperature. The second stage is also used during shut-down of a nozzle to scavenge residual fuel between the fuel valve and the nozzle tip. In the third stage, fuel is admitted to the nozzle. In mechanical atomization, steam is shut off in the third stage but, in steam atomization, steam is delivered to the nozzle through a separate path.

Details of the apparatus for carrying out these operations, and further objects and advantages of the invention will be apparent from the following detailed description when read in conjunction with the drawings.

DETAILED DESCRIPTION

Figure 1:
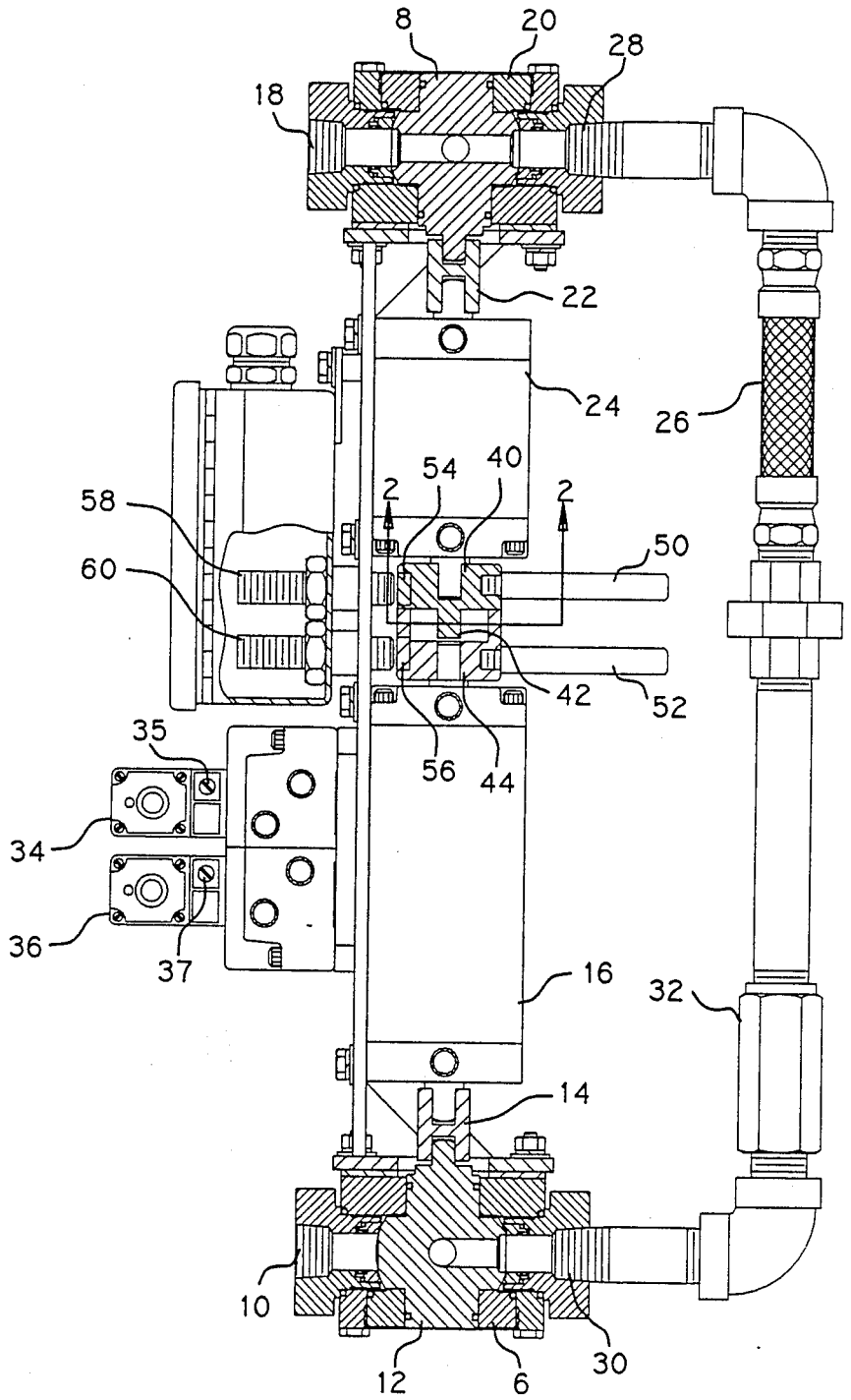
FIG. 1 is a plan view of a valve apparatus in accordance with the invention, partly in section to show the interiors of the valves and the interior of the lost-motion coupling.

Referring to FIG. 1, the valve apparatus of the invention comprises a first, two-position, rotary valve 6 and a second three-positon rotary valve 8. Valve 6 has an inlet port 10 connectable to a fuel supply, and a movable ball element 12 coupled directly by coupling 14 to a rotary actuator 16.

Valve 8 has an inlet port 18 connectable to a supply of steam or other scavenging gas such as air, and a movable ball element 20 connected through a coupling 22 to a rotary actuator 24.

As will become apparent from the following description, the two valves can have various numbers of ports and internal passage configurations, depending on the application of the valve apparatus. In the preferred embodiment of the invention, valve 6 is a two-position valve rotatable through an angle of 90°, and valve 8 is a three-position valve rotatable through an angle of 180°.

The rotary actuators are preferably pneumatically driven vane-type actuators of the kind depicted in U.S. Pat. No. 4,474,105, dated Oct. 2, 1984 and U.S. Pat. No. 4,475,738, dated Oct. 9, 1984. The disclosures of both patents are incorporated by reference.

Each of the actuators is drivable by air pressure in both directions. Actuator 16 is designed to produce a greater torque than actuator 24 for a given operating air pressure, so that actuator 16 can establish an intermediate position for valve 8. Preferably, actuator 16 has a dual-vane rotor, whereas the rotor of actuator 24 has a single vane.

A cross-over connection 26 is provided from port 28 of valve 8 to port 30 of valve 6. A one-way check valve 32 may be provided in the cross-over connection, depending on the particular application of the valve apparatus. The check valve presents fuel from flowing into the steam or air supply lines. It is used in high pressure mechanical atomization and in steam or air atomization, but not in wide range mechanical atomization, because in the latter case fuel and steam flow in opposite directions through the cross-over line at different times.

The actuators are operated by solenoid pilot valves 34 and 36. Each of these pilot valves is of a duel-coil design, requiring a momentary signal to actuate it. As each coil in a pilot valve is energized, the valve is shifted, and maintained in the shifted position without the need for further coil energization. Adjustable restrictors 35 and 37 are provided in the air passages to control the rate of operation of the actuators.

Figure 2:
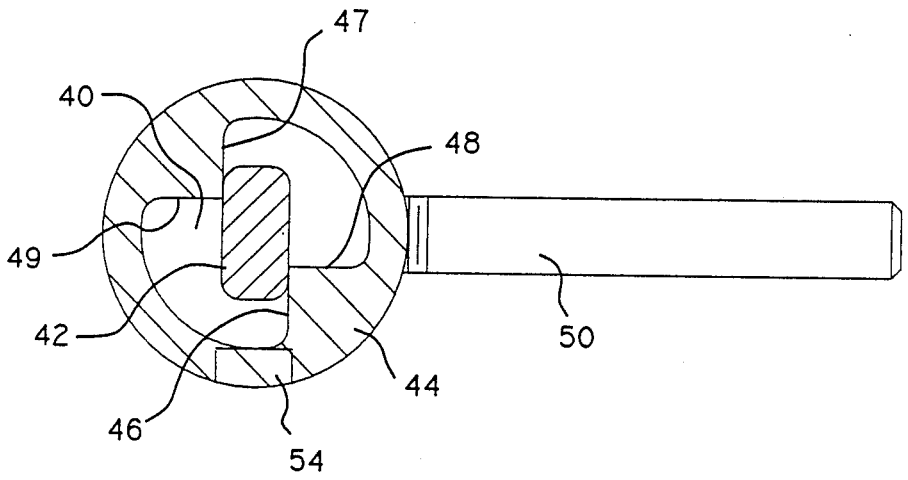
FIG. 2 is a sectional view of the lost-motion coupling, as seen through plane 2—2 of FIG. 1.

Each actuator has its shaft extending through both of its ends, and the shafts of the two actuators are connected together through a lost-motion coupling 38. Coupling 38 comprises a first part 40 connected to the rotor of actuator 24, and having a generally rectangular projection 42. The coupling also comprises a second part 44 connected to the rotor of actuator 16. Rotor 44 has a hollow space receiving projection 42. As shown in FIG. 2, the hollow space of part 44 has a first pair of surfaces 46 and 47, engageable by projection 42 to limit rotation of projection 42 in one direction, and a second pair of surfaces 48 and 49 arranged to limit rotation of projection 42 in the opposite direction. These surfaces are preferably so arranged as to allow projection 42 to rotate through an angle of 90°, assuming that part 44 of the coupling is held stationary. By limiting rotation of projection 42 these surfaces limit rotation of actuator 42 and the movable element 20 of valve 8.

As shown in FIG. 1, coupling part 40 is provided a lever 50 and coupling part 44 is provided with a similar lever 52. These levers enable the valve to be operated manually for example in the event that the actuator air supply fails.

Magnets 54 and 56 on the respective coupling parts actuate proximity switches 58 and 60. These proximity switches provide signals indicating the positions of the valves. The signals can be used simply to operate visual indicating devices, or can be delivered through wiring to automatic valve control apparatus.

Figure 3:
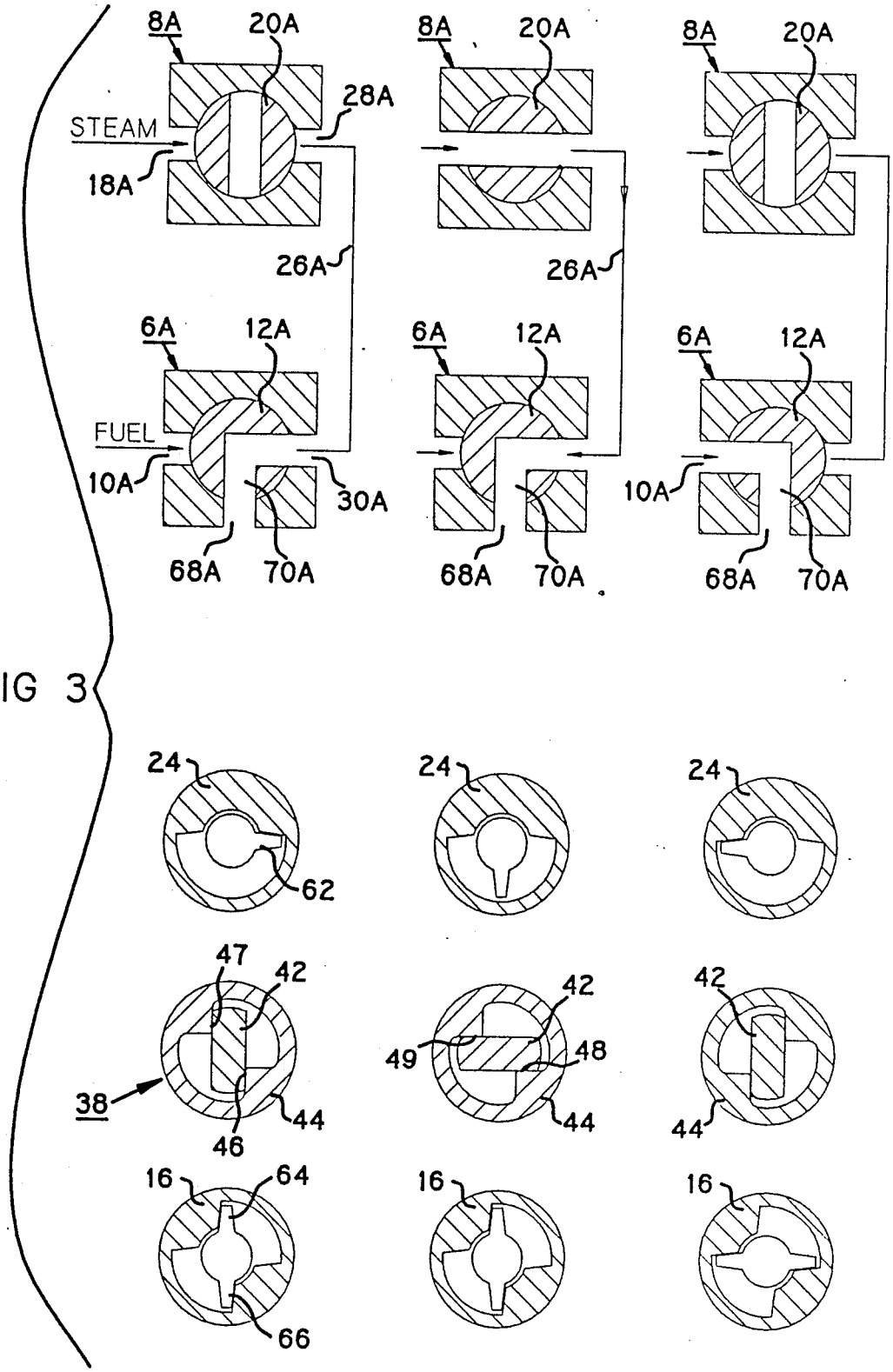
FIG. 3 is a schematic view showing valve and actuator positions for the three stages of operation in a simple high-pressure mechanical atomization system.

The lower part of FIG. 3 shows the three stages of operation of the actuators, and also the corresponding positions of coupling 38. At the left of FIG. 3, the rotor of actuator 24 is positioned fully counterclockwise, with its single vane 62 against a stop. The rotor of actuator 16 is also fully counterclockwise, with its two vanes 64 and 66 resting against stops. Projection 42 of the coupling rests against surfaces 46 and 47 of coupling part 44.

In the second stage of operation, depicted in the vertically aligned diagrams midway between the left and right sides of FIG. 3, the rotor of actuator 16 is in the same position as in the first stage of the operation. Likewise, coupling part 44 is in the same position. The rotor of actuator 24 is rotated clockwise by air pressure, but its clockwise rotation is limited to 90° by the engagement of coupling projection 42 with surfaces 48 and 49 of coupling part 44.

In the third stage of operation, depicted at the right side of FIG. 3, the rotor of actuator 16 is rotated pneumatically 90° clockwise. This causes part 44 of the coupling to rotate 90° clockwise, allowing projection 42, and the rotor of actuator 24 to rotate clockwise, so that the latter is in its fully clockwise position, 180° away from its initial position.

Thus, as will be apparent from the lower portion of FIG. 3, the lost-motion coupling 38, and the counterclockwise torque exerted on the rotor of actuator 16 in the second stage of operation, permit actuator 24 to serve effectively as a three-position actuator. The three-position operation of actuator 24 is not essential when the mode of operation is simple high pressure mechanical atomization. However, three-position operation of actuator 24 is significant in the case of wide range mechanical atomization and in the case of steam atomization.

The upper part of FIG. 3 depicts the three stages of valve positions for high-pressure mechanical atomization. Valve parts in FIG. 3 which correspond to valve parts in FIG. 1 are correspondingly numbered, but followed by the letter "A".

In the first stage of operation, as depicted at the left of FIG. 3, both the steam supply and the fuel supply are cut off. In the second stage, movable element 20A of valve 8A rotates 90° clockwise while movable element 12A of valve 6A remains in its initial position. Steam flows through valve 8A, through cross-over connection 26A, and through passage 70A and port 68A of valve 6A to the nozzle. The steam clears the passages between valve 6A and the nozzle of condensate, and warms the nozzle to operating temperature. The application of steam to the nozzle can be under timer control.

In the third stage, valve element 12A is rotated 90° clockwise. This allows valve element 20A to rotate through another 90°, shutting off the steam supply. Fuel passes through port 10A, passage 70A and port 68A of valve 6A to the nozzle.

When the nozzle is to be shut down, actuator 16 is pneumatically returned to the condition depicted in the middle diagram at the bottom of FIG. 3. This causes valve 6A to shut off the fuel supply to the nozzle, and at the same time opens valve 8A to admit steam to the nozzle. Opening of valve 8A occurs because the higher torque of actuator 16 overrides the torque urging the rotor of actuator 24 clockwise. As the movable element 12A of valve 6A is rotated counterclockwise to cut off fuel flow, valve 8A is cracked open, and gradually admits steam pressure (which is greater than the fuel pressure), through cross-over connection 26A, to the feed line between valve 6A and the nozzle. The steam pressure behind the fuel in this line maintains fuel pressure at the tip of the nozzle until all of the fuel is scavenged and burned. Thus, flame-out is avoided. Here again, the duration of the scavenging operation can be timer controlled.

Upon completion of the scavenging operation, actuator 24 is operated counterclockwise to shut off valve 8A, thereby returning the apparatus to the condition depicted at the left of FIG. 3.

Figure 4:
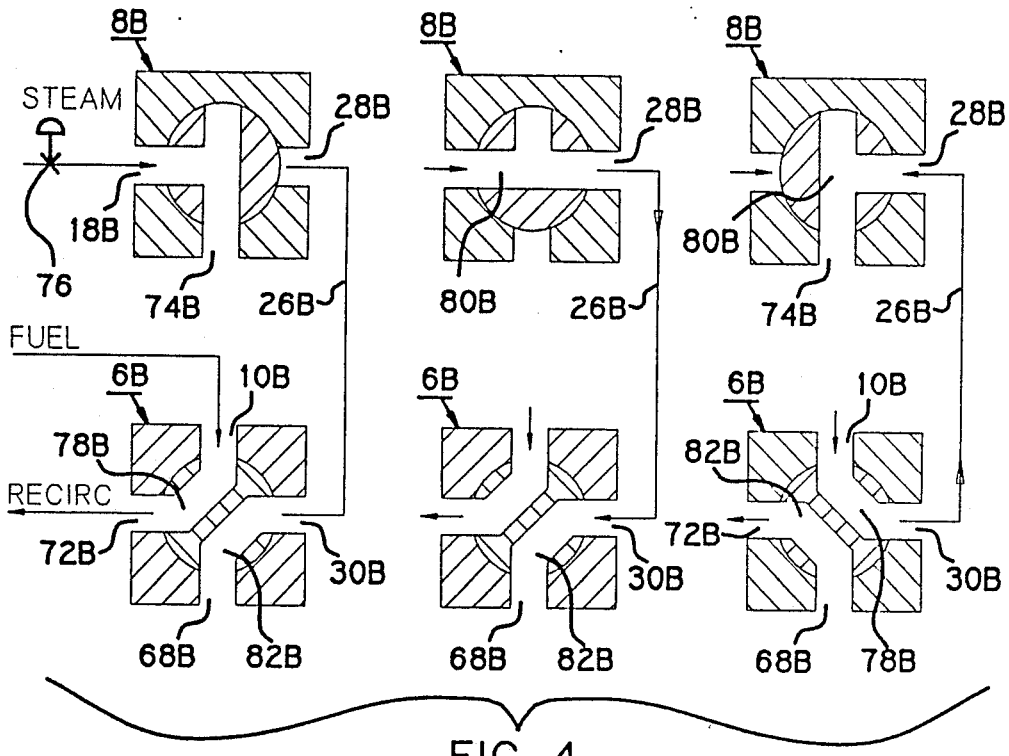
FIG. 4 is a schematic view showing the valves and valve positions for a wide range mechanical atomization system, the corresponding actuator positions being as shown in FIG. 3.

FIG. 4 illustrates the diagrammatically a pair of valves, and three stages of valve positions for wide range mechanical atomization. The very same actuators and couplings are used as are used in the case of simple high-pressure mechanical atomization. The corresponding actuator and coupler conditions are as shown in FIG. 3, and are not duplicated in FIG. 4.

Valve 6B in FIG. 4 is a four-port, two-position valve having a fuel inlet port 10B, a recirculation port 72B, a cross-over port 30B, and a port 68B connectable to the return line of the nozzle. Valve 6B has two separate internal passages 78B and 82B.

Valve 8B is a three-position, three-port valve having a steam inlet port 18B, a cross-over port 28B, and a port 74B connectable to the feed line which carries fuel to the nozzle. A separate steam shut-off valve 76 is connected in series with port 18B. The valve element has a T-shaped passage 80B.

The nozzle used in connection with the valving of FIG. 4 is a nozzle having a fuel feed line connected to port 74B of valve 8B and a fuel return line, connected to port 68B of valve 6B. The rate at which fuel is delivered from the nozzle is controlled by controlling back pressure by means of a control valve (not shown) connected to port 72B.

In the initial stage, the valves 6B and 8B are in the conditions shown at the left of FIG. 4, and auxiliary steam valve 76 is shut off. Fuel from the fuel supply is recirculated through port 10B, valve passage 78B and port 72B.

Before proceeding to the second stage of operation, auxiliary steam valve 76 is opened to admit steam to the fuel feed line between port 74B and the nozzle. Thereafter, in the second stage of operation, valve 8B is rotated 90° clockwise, while valve 6B remains in its initial condition. Steam is delivered through port 18B, valve passage 80B, port 28B, cross-over connection 26B, port 30B, valve passage 82B and port 68B to the nozzle through the fuel return line. Thus, steam is admitted to the nozzle both through the fuel delivery line, and through the fuel return line in separate steps.

In the third stage of operation, depicted at the right side of FIG. 4, valve 6B is rotated 90° clockwise. At this time, the coupling allows valve 8B to rotate clockwise under the urging of actuator 24, through a further 90° angle. Steam is shut off by valve 8B. Fuel is delivered through port 10B, passage 82B, port 30B, cross-over line 26B, port 28B, passage 80B, and port 74B to the nozzle. Fuel is returned from the nozzle through port 68B, valve passage 82B and port 72B.

When the nozzle is to be shut down, valve 6B is rotated counterclockwise while air pressure continues to urge valve 8B clockwise. However, the air pressure urging valve 6B counterclockwise overrides the air pressure urging valve 8B clockwise, and accordingly, both valves 6B and 8B return to the condition depicted midway between the left and right sides of FIG. 4. During this operation, steam is gradually admitted through port 68B to the nozzle, thereby purging fuel from the fuel return line. When purging of the fuel return line is complete, preferably under timer control, the actuator which operates valve 8B is operated to cause valve 8B to rotate counterclockwise through a further 90° angle so that both valves are in their initial condition as depicted at the left of FIG. 4. Auxiliary steam valve 76 is then allowed to remain open for a period of time under timer control to purge oil from the feed line which delivers fuel from port 74B to the nozzle.

Figure 5:
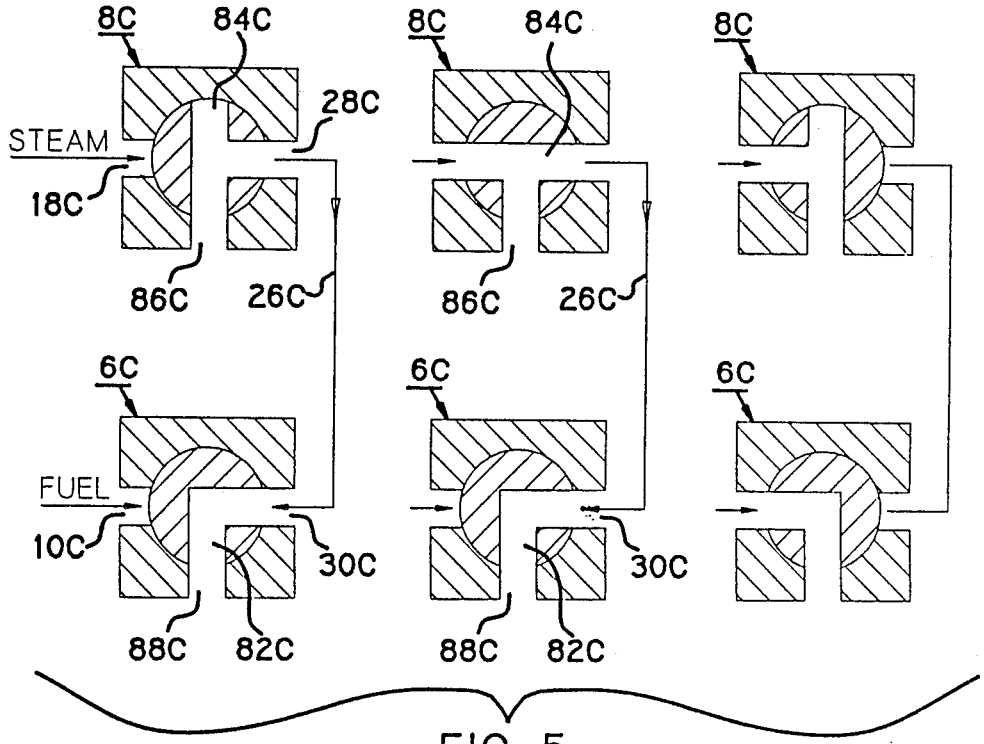
FIG. 5 is a schematic view showing the valves and valve positions for a steam atomized system, the corresponding actuators positions being as shown in FIG. 3.

FIG. 5 depicts the three principal stages of operation of the valve apparatus, when used in a steam atomization burner system. Valve 6C is a three-port, two-position valve having an L-shaped passage 82C in its movable element. Valve 8C is a three-port, three-position valve having a T-shaped passage 84C in its movable element.

In the initial condition of the valves, as depicted at the left of FIG. 5, ports 10C and 18C are both closed, thereby cutting off the flow of fuel and steam.

In the case of steam atomization, the nozzle is designed with separate steam and fuel lines. The steam line is connected to port 86C of valve 8C, and the fuel line is connected to port 88C of valve 6C. Ports 28C and 30C are connected by cross-over connected 26C.

In the second stage of operation, valve 8C is rotated 90° clockwise, while valve 6C remains in its initial condition. Steam is admitted through passage 84C and port 86C to the nozzle through the steam line, and is simultaneously admitted through valve passage 84C, port 28C, cross-over connection 26C, port 30C, valve passage 82C and port 88C to the nozzle through the fuel line. Thus, steam is simultaneously admitted to the nozzle through two lines. Admission of steam is carried out in this stage for a timer-controlled interval to warm the nozzle to its proper operating temperature.

Thereafter, valve 6C is rotated 90° clockwise by its actuator to the condition depicted at the right of FIG. 5. At this time, the lost-motion coupling allows valve 8C to rotate clockwise through a further 90° angle to the condition depicted at the right of FIG. 5. Steam is admitted to the nozzle through valve 8C, and fuel is simultaneously admitted to the nozzle through valve 6C. The steam is used to effect atomization of the fuel at the nozzle tip.

When the nozzle is to be shut down, the actuator which operates valve 6C is operated to cause valve 6C to rotate 90° counterclockwise. Valve 8C is simultaneously forced to rotate 90° counterclockwise to its intermediate position. At this time, steam is gradually admitted through port 88C to the fuel feed line leading from port 88C to the nozzle, thereby purging fuel from this line and from the nozzle while avoiding flame-out. After an appropriate timer-controlled purging interval, the actuator which controls valve 8C is operated to rotate valve 8C counterclockwise, thereby shutting off the flow of steam.

As will be apparent from the foregoing, the valve system can be adapted to all three principal atomization methods simply by substituting valves, the other parts of the valve system being the same for all three cases. The valve system is structurally simple, inexpensive, and easily maintained because substantially all of its parts are readily available, off-the-shelf items.

Modifications can be made to the apparatus described. For example, whereas in the specific embodiment shown in FIG. 1, the lost-motion coupling is connected directly to actuator shafts, if valves having shafts extending in both directions are used, the positions of the actuators and valves can be reversed, and the lost-motion coupling can be connected directly to the valves.

Whereas, for simplicity, the valves rotate in 90° steps, it is possible to use rotary valves which rotate through angular displacements other than 90° in each step.

While the valve apparatus has been described as an apparatus for controlling the flow of liquid fuel and scavenging gas in a power plant boiler, the valve apparatus can also be used in other applications where it is desired to control the flow of two different fluids alternately to a single destination. The valve apparatus can be used, for example in chemical processing where mixing or atomization is required, or in a cleaning apparatus, where two different fluids are applied to a surface to be cleaned.

Further modifications and uses of the apparatus may be made without departing from the scope of the invention as defined in the following claims.

I claim:

1. A valve apparatus for use in controlling the flow of two different fluids alternately to a single destination comprising:

a first rotary valve having a valve element movable by rotation through a first angular displacement between first and second valve positions;

a first fluid-driven actuator connected to operate said first valve through said first angular displacement between a first limit in which the first valve is in its first position and a second limit in which the first valve is in its second position;

a second rotary valve having a valve element movable by rotation through a second angular displacement greater than said first angular displacement between first and third valve positions through a second valve position;

a second fluid-driven actuator connected to operate said second valve through said second angular displacement between a third limit in which the second valve is in its first valve position, through an intermediate position in which the second valve is in its second valve position, to a fourth limit in which the second valve is in its third valve position;

lost-motion coupling means connected to said first and second valves, said coupling means (a) permitting the second actuator to rotate the second valve to its second valve position while the first valve is in its first position, (b) preventing the second valve from moving beyond its second position when the first valve is in its first position, and (c) permitting the second rotary valve to rotate to its third position when the first valve is in its second position;

the first fluid-driven actuator exerting a greater torque than the second fluid-driven actuator, whereby, when the first rotary valve is in its first position, the coupling means prevents the second rotary valve from moving beyond its second valve position towards its third valve position; and said rotary valves including a first fluid inlet port connectable to receive a first fluid from a fluid supply, a second fluid inlet port connectable to receive a second fluid from a fluid supply, and an outlet port, said valves being connected and arranged to prevent the flow of the first fluid to the outlet port when the valves are in their first positions, to permit the flow of the second fluid to said outlet port when the first valve is in its first valve position and the second valve is in its second valve position, and to permit the flow of the first fluid to said outlet port when the first valve is in its second valve position and the second valve is in its third valve position.

2. A valve apparatus according to claim 1 in which:

the first rotary valve has first, second and third ports and the valve element of the first rotary valve interconnects the second and third ports when in its first valve position while blocking flow through said first port, and interconnects the first and second ports when in its second valve position;

the second rotary valve has fourth and fifth ports and the valve element of the second rotary valve blocks flow between said fourth and fifth ports when in its first and third valve positions and interconnects the fourth and fifth ports when in its second valve position; and the first fluid inlet port is said first port of the first rotary valve, the second fluid inlet port is said fourth port of the second rotary valve, and the outlet port is the second port of the first rotary valve; and having means providing a cross-over passage interconnecting said third and fifth ports.

3. A valve apparatus according to claim 1 in which:

the first rotary valve has first, second, third and fourth ports and the valve element of the first rotary valve interconnects the first port with the second port and interconnects the third port with the fourth port when in its first valve position while blocking flow between the second and fourth ports, and interconnects the first port with the third port and interconnects the second port with the fourth port when in its second valve position;

the second rotary valve has fifth, sixth and seventh ports, and the valve element of the second rotary valve interconnects the fifth and sixth ports when in its first valve position while blocking flow through the seventh port, interconnects the fifth and seventh ports when in its second valve position while blocking flow through said sixth port, and interconnects the sixth and seventh ports when in its third valve position while blocking flow through said fifth port; and the first fluid inlet port is said second port of the first rotary valve, the second fluid inlet port is said fifth port of the second rotary valve and the outlet port is the sixth port of the second rotary valve; and having means providing a cross-over passage interconnecting said fourth and seventh ports.

4. A valve apparatus according to claim 3 having an auxiliary shut-off valve connected to the fifth port of the second rotary valve.

5. A valve apparatus according to claim 1 in which:

the first rotary valve has first, second and third ports and the valve element of the first rotary valve interconnects the second and third ports when in its first valve position while blocking flow through said first port, and interconnects the first and second ports when in its second valve position;

the second rotary valve has fourth, fifth and sixth ports and the valve element of the second rotary valve interconnects the fifth and sixth ports when in its first valve position while blocking flow through said fourth port, interconnects the fourth, fifth and sixth ports when in its second valve position, and interconnects the fourth and fifth ports while in its third valve position, while blocking flow through said sixth port; and the first fluid inlet port is said first port of the first rotary valve, the second fluid inlet port is said fourth port of the second rotary valve, and the outlet port is the second port of the first rotary valve; and having means providing a cross-over passage interconnecting said third and sixth ports.

6. A valve apparatus for use in controlling the flow of liquid fuel and scavenging gas in a combustion apparatus comprising:

a first rotary valve having a valve element movable by rotation through a first angular displacement between first and second valve positions;

a first fluid-driven actuator connected to operate said first valve through said first angular displacement between a first limit in which the first valve is in its first position and a second limit in which the first valve is in its second position;

a second rotary valve having a valve element movable by rotation through a second angular displacement greater than said first angular displacement between first and third valve positions through a second valve position;

a second fluid-driven actuator connected to operate said second valve through said second angular displacement between a third limit in which the second valve is in its first valve position, through an intermediate position in which the second valve is in its second valve position, to a fourth limit in which the second valve is in its third valve position;

lost-motion coupling means connected to said first and second valves, said coupling means (a) permitting the second actuator to rotate the second valve to its second valve position while the first valve is in its first position, (b) preventing the second valve from moving beyond its second position when the first valve is in its first position, and (c) permitting the second rotary valve to rotate to its third position when the first valve is in its second position;

the first fluid-driven actuator exerting a greater torque than the second fluid-driven actuator, whereby, when the first rotary valve is in its first position, the coupling means prevents the second rotary valve from moving beyond its second valve position toward its third valve position; and said rotary valves including a fuel inlet port connectable to receive fuel from a fuel supply, a gas inlet port connectable to receive a scavenging gas from a gas supply, and a nozzle port connectable to a burner nozzle, said valves being connected and arranged to prevent the flow of fuel to the nozzle port when the valves are in their first positions, to permit the flow of scavenging gas to said nozzle port when the first valve is in its first valve position and the second valve is in its second valve position, and to permit the flow of fuel to said nozzle port when the first valve is in its second valve position and the second valve is in its third valve position.

7. A valve apparatus according to claim 6 in which:

the first rotary valve has first, second and third ports and the valve element of the first rotary valve interconnects the second and third ports when in its first valve position while blocking flow through said first port, and interconnects the first and second ports when in its second valve position;

the second rotary valve has fourth and fifth ports and the valve element of the second rotary valve blocks flow between said fourth and fifth ports when in its first and third valve positions and interconnects the fourth and fifth ports when in its second valve position; and the fuel inlet port is said first port of the first rotary valve, the gas inlet port is said fourth port of the second rotary valve, and the nozzle port is the second port of the first rotary valve; and having means providing a cross-over passage interconnecting said third and fifth ports.

8. A valve apparatus according to claim 6 in which:

the first rotary valve has first, second, third and fourth ports and the valve element of the first rotary valve interconnects the first port with the second port and interconnects the third port with the fourth port when in its first valve position while blocking flow between the second and fourth ports, and interconnects the first port with the third port and interconnects the second port with the fourth port when in its second valve position;

the second rotary valve has fifth, sixth and seventh ports, and the valve element of the second rotary valve interconnects the fifth and sixth ports when in its first valve position while blocking flow through the seventh port, interconnects the fifth and seventh ports when in its second valve position while blocking flow through said sixth port, and interconnects the sixth and seventh ports when in its third valve position while blocking flow through said fifth port; and the fuel inlet port is said second port of the first rotary valve, the gas inlet port is said fifth port of the second rotary valve and the nozzle port is the sixth port of the second rotary valve; and having means providing a cross-over passage interconnecting said fourth and seventh ports.

9. A valve apparatus according to claim 8 having an auxiliary gas shut-off valve connected to the fifth port of the second rotary valve.

10. A valve apparatus according to claim 6 in which:

the first rotary valve has first, second and third ports and the valve element of the first rotary valve interconnects the second and third ports when in its first valve position while block flow through said first port, and interconnects the first and second ports when in its second valve position;

the second rotary valve has fourth, fifth and sixth ports and the valve element of the second rotary valve interconnects the fifth and sixth ports when in its first valve position while blocking flow through said fourth port, interconnects the fourth, fifth and sixth ports when in its second valve position, and interconnects the fourth and fifth ports while in its third valve position, while blocking flow through said sixth port; and the fuel inlet port is said first port of the first rotary valve, the gas inlet port is said fourth port of the second rotary valve, and the nozzle port is the second port of the first rotary valve; and having means providing a cross-over passage interconnecting said third and sixth ports.

* * * * *